United States Patent [19]

Graves et al.

[11] 4,316,116

[45] Feb. 16, 1982

[54] TRIPLE-COIL INCANDESCENT FILAMENT

[75] Inventors: James A. Graves, Highland Hts.; Gilbert H. Reiling, Chardon, both of Ohio

[73] Assignee: General Electric Company, Schenectady, N.Y.

[21] Appl. No.: 105,580

[22] Filed: Dec. 19, 1979

[51] Int. Cl.[3] ..... H01K 1/14

[52] U.S. Cl. ..... 313/344; 313/326

[58] Field of Search ..... 313/344, 326; 29/25.14, 29/25.17, 25.18

[56] References Cited

U.S. PATENT DOCUMENTS

| | | | |
|---|---|---|---|
| 1,180,159 | 4/1916 | Langmuir | 313/185 |
| 1,247,068 | 10/1913 | Benbow | 313/344 |
| 2,142,865 | 1/1939 | Zabel | 313/344 |
| 2,306,925 | 12/1942 | Aicher | 313/344 |
| 2,774,918 | 12/1956 | Lemmers | 313/344 |
| 4,208,609 | 6/1980 | Berlec | 313/344 |

FOREIGN PATENT DOCUMENTS

| | | |
|---|---|---|
| 551623 | 4/1923 | France . |

*Primary Examiner*—Eugene R. LaRoche
*Attorney, Agent, or Firm*—Lawrence R. Kempton; Philip L. Schlamp

[57] ABSTRACT

This invention relates to multiple coiled incandescent filaments and more particularly to a single strand filament wire, coreless, triple-coil filament for an incandescent lamp having mandrel ratios in either or both its second or third coiling less than 1.0.

5 Claims, 5 Drawing Figures

TRIPLE-COIL INCANDESCENT FILAMENT

This invention relates to multiple coiled incandescent filaments and more particularly to a single strand filament wire, coreless, triple-coil filament for an incandescent lamp having mandrel ratios in either or both its second or third coiling less than 1.0.

Filament coiling as taught by Langmuir in U.S. Pat. No. 1,180,159 improves incandescent filament efficacy. The conductive and convective heat losses from a coiled filament 10 mils in diameter and an uncoiled filament 3 mils in diameter are essentially equal while the light-emitting surface area of the coiled filament is approximately three times as large as the surface area of the uncoiled 3 mil filament. Light output is proportional to the light-emitting surface area and hence a lamp having a coiled filament exhibits improved efficacy in lumens output for a given wattage input. Although coiled filaments have short lengths, they have large diameters because a wire having a diameter d cannot, without special preparations be coiled about a mandrel having a diameter M which is less than d. Accordingly, the mandrel ratio (M/d) of a coiled filament is always greater than 1.0.

Coiled-coil filaments as taught by Benbow, in U.S. Pat. No. 1,247,068 also exhibit improved efficacy. The Benbow filament design incorporates long lengths of filament wire within a coil of shorter length but large outside diameter.

The overall filament configuration is additionally dependent on the separation, S, between adjacent windings for the coiled and a coiled-coil filament. The winding separation S is restricted such that the pitch ratio (S/D) is normally in the range of 1.4–1.8 where D is the wire or coil diameter. A minimum winding separation S ensures adequate spacing between adjacent windings of a coil such that the windings do not contact or short each other when the coil is coiled again. A maximum winding separation reduces the possibility that the filaments will interwine and tangle.

Although triple coils have heretofore been suggested as a logical extension of the coiled-coil technique to improve efficacy, a practical triple-coil filament employing a tungsten wire having a diameter of 4.5 mils or less has not been achieved. Coiling the above coiled-coil filaments a third time produces an even larger filament which is awkward and does not exhibit substantially improved lamp efficacy. Additionally, the third coiling reduces the filament lengths and necessitates a new lead wire configuration.

Finer more resistive filament wires (having a diameter less than 4.5 mils) do not have sufficient inherent rigidity to adequately support a triple-coil filament. Triple coil filaments condense the filament length and mass. Fine filament wires have, heretofore been unable to rigidly support this concentration. Triple-coil filaments have been made with permanent cores within the primary coil to impart sufficient rigidity to the filament. These cored filaments are not true triple-coil filaments but are instead enhanced surface area coiled-coil filaments which do not substantially improve lamp efficacy inasmuch as the primary coil is shorted by the core.

SUMMARY OF THE INVENTION

The present invention overcomes the problems heretofore associated with the triple-coil filament and provides a coreless triple-coil filament having a diameter approximately equal to the diameter of a corresponding wattage coiled-coil filament while exhibiting improved efficacy.

Additionally, the triple-coil filament enables the use of fine high-resistivity filament wire without the aforementioned problems of filament sag and shorter filament length.

The triple-coil filament of the present invention is not restricted to a maximum pitch or winding separation in the first coiling and accordingly provides a filament having a length which is freely adjustable.

The coreless triple coil incandescent filament in accordance with the present invention is formed from a single strand of fibrous filament wire which is wound around a first mandrel to produce a primary coil, which primary coil, with its first mandrel in place, is subsequently wound around a second mandrel to produce a coiled-coil configuration. The coiled-coil configuration with both mandrels in place is then wound around a third mandrel to produce a coiled-coiled-coil or triple-coil filament configuration. The diameter of either or both the second or third mandrel is less than the diameter of the preceding coil. The filament is sintered and annealed and the mandrels are dissolved to yield a coreless triple-coil incandescent filament.

A triple-coil filament of the present invention employs a mandrel ratio (M/D) in either or both the second or third coiling of less than one. Smaller, tighter, more efficient filament coils are thereby achieved and these coils exhibit sufficient rigidity to support the concentrated length and mass of the triplecoil filament. In a preferred embodiment the diameter of the triple-coil is less than 27 times the wire diameter. In an alternate embodiment at least one of the coils of the triple coil filament has a mandrel ratio less than one.

Reduced mandrel ratio coiling is particularly applicable to inherently flexible fibrous tungsten wire having a diameter of 4.5 mils or less. The reduced mandrel ratio coiling imparts rigidity to the inherently flexible wire and thereby affects a rigid triple-coil filament configuration.

Triple-coil filaments of the present invention are inherently stable and in a preferred embodiment are formed in symmetrical configurations such as approximately spherical or cylindrical filaments. Symmetrical filament configurations are particularly suited to cooperate with symmetrical lamp envelope configurations used, in for instance IR reflecting lamps, wherein the lamp envelope is coated with a material which reflects the infrared radiation produced by the filament back to the filament to improve the heat maintenance of the filament and improve the efficacy of the lamp.

Additionally the reduced mandrel ratio triple-coil filament in a preferred embodiment is formed as a 220–240 volts coil which is compatible with present lamp making machinery designed for 120 volt coils.

Further objects and features and a more complete understanding of the present invention which may admit to a number of possible variations will be seen from the following detailed description which taken in conjunction with the attached drawings represents the preferred embodiments of this invention.

DETAILED DESCRIPTION OF THE DRAWINGS

Figure 1:
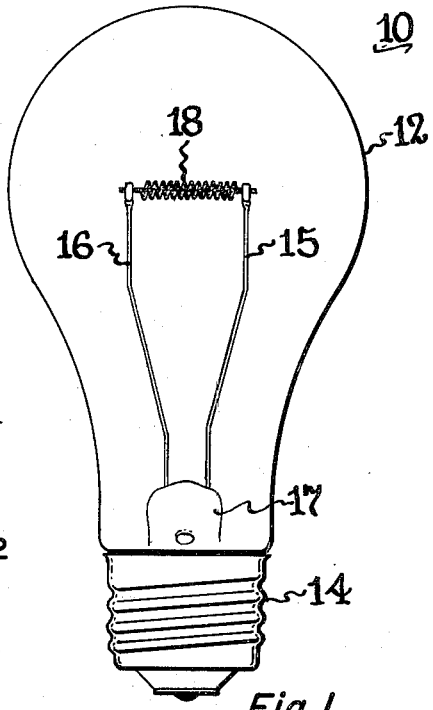
FIG. 1 is an illustration of a triple-coil filament as applied in an incandescent lamp.

FIG. 1 shows an incandescent lamp 10 having a hermetically sealed translucent envelope 12 sealed within a metallic base 14. Two electrical lead and support wires 15 and 16 are rigidly disposed within the envelope 12 by the stem 17. A triple-coil filament 18 is clamped between the interior ends of the two lead wires 15 and 16 which electrically connect and support the filament 18. The opposite ends of the lead wires 15 and 16 extend through the stem 17 and make electrical connection with appropriate portions of the metallic base 14 as known in the art (not shown). Although the particular mount arrangement as shown in a CCC-6 or horizontal filament mount, the filament 18 is employed in alternate embodiments in a variety of mounting arrangements which may include for instance a vertical or CCC-8 mount.

Figure 2:
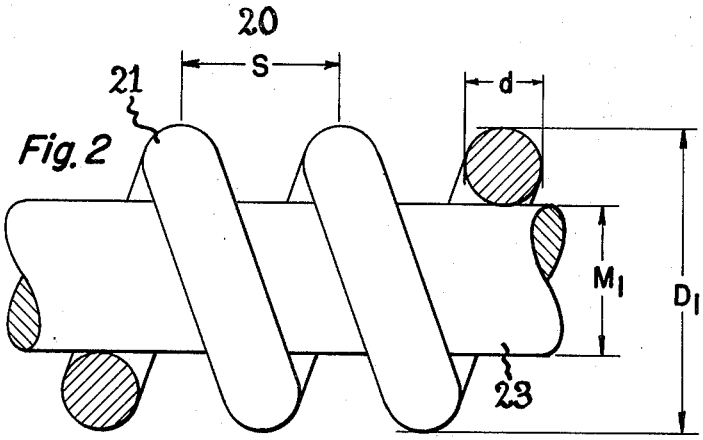
FIG. 2 is an illustration of a filament wire which is wound around a first mandrel to form a coiled filament.

Referring now to FIG. 2 which shows a primary filament coil 20 formed of a refractory metal wire 21 having a diameter d which is wound around a first mandrel 23 having a diameter $M_1$. The wire 21 in a preferred embodiment is a single strand fibrous tungsten wire having a diameter of 4.5 mils or less. The mandrel 23 in a preferred embodiment is molybdenum and has a diameter $M_1$ in the range 1.0d–3.0d mils where d is the filament wire 21. The primary coil 20 has a diameter $D_1$ equal to $2d+M_1$.

Figure 3:
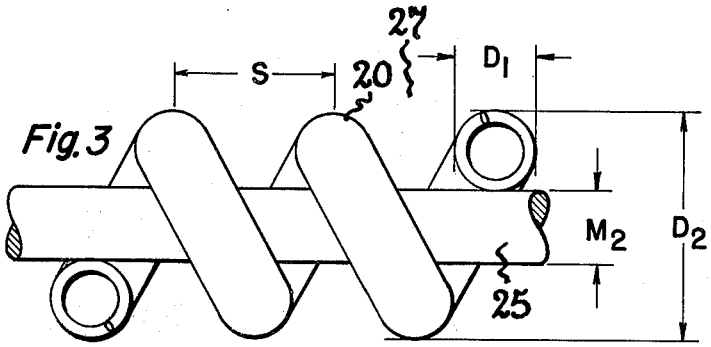
FIG. 3 is an illustration of the coiled filament of FIG. 2 wound around a second mandrel to form a coiled-coil filament.

Referring now to FIG. 3, the primary coil 20 is wound around a second mandrel 25 to form a coiled-coil filament 27. The second mandrel 25 in a preferred embodiment, is molybdenum and has a diameter $M_2$ in the range of $M_1$–$1.8D_1$ mils. The diameter $D_2$ of the coiled-coil filament 27 is $2D_1+M_2$.

Figure 4:
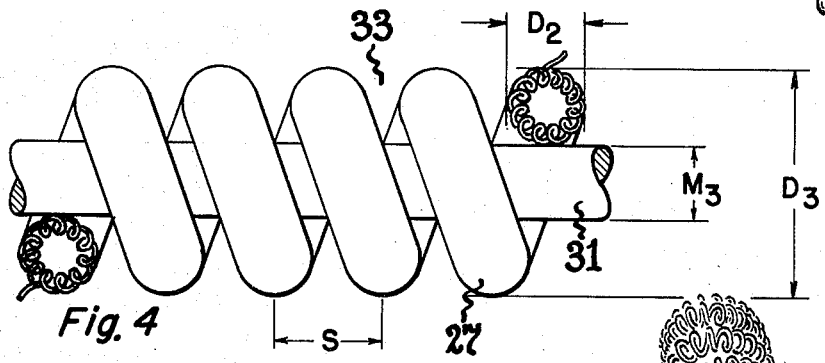
FIG. 4 is an illustration of the coiled-coil filament of FIG. 2 wound around a third mandrel to form a triple-coil filament configuration.

In FIG. 4, the coiled-coil filament 27 is wound around a third mandrel 31 to form a triple-coil filament 33. The third mandrel 31 is the preferred embodiment is molybdenum and has a diameter $M_3$ in the range of $M_2$–$1.8D_2$. The diameter of the triple-coil filament is $D_3$ or $2D_2+M_3$.

Figure 5:
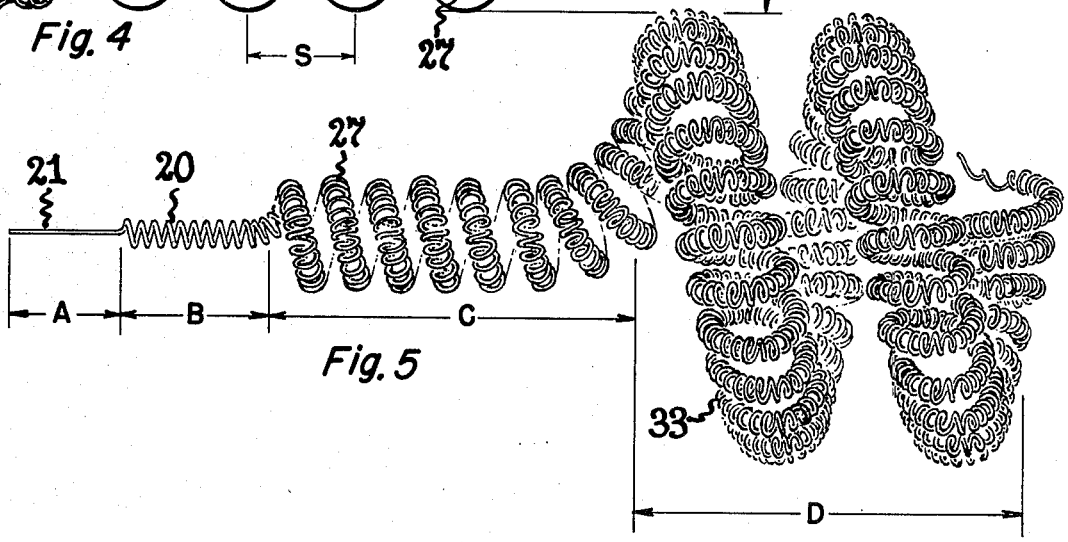
FIG. 5 is an illustration of a triple-coil filament in prespective view.

FIG. 5 is an artist's representation of a triple-coiled filament 33 wherein a section A is uncoiled filament wire 21. Section B is a coiled filament 20. Section C is a coiled-coil filament 27 and Section D is a triple-coil filament 33. The triple-coil filament in a preferred embodiment incorporates and rigidly supports a long length of high resistivity filament wire in a coil of small outside dimension.

The light output of the incandescent lamp 10 is primarily dependent upon the nature of the filament 18 employed therein. The incandescent filament 18 is characterized by its efficacy or lumens per watt applied to the filament. Lamp efficacy is dependent upon both the filament efficacy and the lamp atmosphere. Coiled filaments exhibit better efficacy than uncoiled filaments and filaments coiled more than once exhibit better efficacy than single-coiled filaments, inasmuch as the light-emitting surface area of the filament has been increased without substantially increasing the heat dissipation of the filament. A triple-coil filament in accordance with the present invention increases the light-emitting surface area of the filament without substantially increasing the heat losses of the filament and consequently improves the efficiacy of the filament. Pressurized lamp atmospheres are employed in alternate embodiments to impede tungsten evaporation and provide long life lamps.

The light output of the lamp is also directly related to a filament resistance or wattage at a known voltage. A 60-watt filament at 120 volts has for instance a 240 ohm resistance when hot. The filament resistance R is established by selecting a length of known diameter refractory metal wire having a resistivity, at a specified temperature, which is defined as the resistance of a sample of material of unit length per unit cross section (ohms per circular mil foot). The resistance R of the filament is established by selecting the length and cross-sectional area or diameter of the filament wire 21 as well as the composition of the refractory metal wire.

Fine filament wire 21 alternately enables high resistance standard length filaments for, for instance, high voltage applications (220 volts) or shorter length standard voltage (120 volt) filaments. The triple-coil filament of the present invention enables the use of fine filament wires by providing a smaller, tighter filament which has a mandrel ratio of less than 1.0 in either or both its second and third coiling. Reduced mandrel ratio coiling imparts strength to the coiled filament 20 and affords a rigid fine wire triple coil filament which does not sag.

Adjacent coil windings must also have a minimum separation to insure that the adjacent windings are not touching or shorted. The separation S (as shown in FIGS. 2 and 3) is measured between the midpoint of adjacent windings along the filament axis. The separation S is established by winding the coil at a particular number of turns per inch (TPI).

Pitch ratio relates the winding separation S as a fraction of the coil or wire diameter D and is defined as $Pr=(S/D)$. In the first coiling D is the wire diameter d and in the second coiling D is diameter of the first coil or $2d+M_1$ (where $M_1$) is the diameter of the first mandrel.

Pitch ratios for ordinary coiled and coil-coil filaments are in the range of 1.4 to 1.8. A minimum pitch ratio is necessary to insure minimum separation between adjacent coils to prevent shorting of the primary windings when the primary coils coiled again.

The pitch ratio of greater than 1.8 in a coiled or coiled-coil filament is generally unacceptable inasmuch as the separation S between adjacent windings is large, resulting in filaments which interwine and tangle.

In a triple-coil filament of the present invention, the plane of the primary coil is approximately parallel to the axis of the filament. When the filament 33 is flexed along its axis, the outside separation of the coiled-coil windings is increased while the separation between the primary coil windings 20 is substantially unaffected. Accordingly the separation or pitch of the primary coil in a triple-coil filament does not affect and is not susceptible to filament tangling. The primary coil spacing or separation $S_1$ in the triple-coil filament of the present invention is therefore a substantially unrestricted design freedom which is used to incorporate a variety of different filament wire lengths within a triple-coil of given geometry. For instance both a 220 volt and a 110 volt triple-coil filament can be formed in approximately the same geometry (diameter and length) by adjusting the primary coil spacing (S) or pitch ratio. Particularly, the pitch ratio of the primary coil of triple-coil filament can exceed 2.0 without detrimentally affecting filament operation.

The overall triple-coil diameter is determined by the mandrel ratio of the coilings which is defined as M/D where D is the diameter of the coil or wire being wound and M is the diameter of the mandrel being used. In the primary coil D is the wire diameter d. Heretofore it has generally been accepted in the art that the wire having a diameter d cannot be wound around a mandrel having a diameter M which is less than d. In as much as the elasticity of tungsten and molybdenum are approximately equal, an automated coiling machine winds the wire having the smaller diameter about the mandrel having the larger diameter. Although tensioning a mandrel permits a larger wire to be wound around a smaller mandrel, when the tension is released the coil will contract and tangle. It has heretofore been believed that coils must be wound around mandrels having diameters larger than the coil diameter or that the coil formed therein must have a mandrel ratio greater than 1 and more particularly in the range of 1.4 to 1.8.

The triple-coil filament of the present invention is formed from a filament wire having a diameter of 4.5 mils or less and advantageously employs a mandrel ratio in either or both the second or third coiling of less than 1.0. Either or both the first or second coils are wound around a mandrel having a diameter which is smaller than the diameter of that coil. The mandrel diameter can be as small as the internal diameter of the coil being wound or the mandrel diameter of that coil.

Mandrel ratios of less than 1.0 produce smaller, tighter coils having improved rigidity and strength. Mandrel ratios of less than 1.0 enable the use of fine filament wire 21 (4.5 mils or less in diameter) inasmuch as the smaller, tighter coils impart strength to the normally flexible filament wire 21 to thereby obviate the possibility of filament sag. Accordingly, the combination of fine filament wire and a mandrel ratio of less than 1.0 enables the production of practical triple coil filaments 33 having pre-specified resistances which can be formed in a variety of triple-coil filament configurations including configurations having symmetrical geometries with minimal outside diameters. More particularly, a 220 volt triple-coil incandescent filament can be produced having approximately the same diameter and length as a standard 110 volt coiled-coil filament. Alternatively, a 110 volt triple-coil filament can be produced having a substantially spherical geometry to cooperate efficiently with particular envelope geometry as for instance required in infrared lamp applications. The triple-coil filament of the present invention is concisely described in terms of coiling parameter and dimensions. The diameter of the primary coil $D_1$ is equal to $(2d+M_1)$. The diameter of the coiled-coil $D_2$ is equal to $(2D_1+M_2)$ or $4d+2M_1+M_2$. The diameter of the triple coil $D_3$ is equal to $(2D_2+M_3)$ or $8d+4M_1+2M_2+M_3$.

In order to effect triple coiling in accordance with the present invention, either or both the second or third mandrel diameters $M_2$ and $M_3$ are respectively less than the diameters of the preceeding coils $D_1$ and $D_2$.

Coiling techniques heretofore known in the art have specified that 1.00 is the absolute minimum for mandrel ratios. It is also known that excessive wire and mandrel breakage occurs with mandrel ratio of less than 1.20. A mandrel ratio of 1.4 is typical of many coils. A triple coil which is produced with mandrel ratios equal to 1.4, employs a primary mandrel having a diameter $M_1$ equal to 1.4d, a second mandrel having a diameter $M_2$ equal to 4.76d and a third mandrel having a diameter $M_3$ equal to 16.2d. The diameter $D_3$ of a triple coil having 1.4 mandrel ratios is 39.32d. The heretofore believed absolute minimum mandrel ratio of 1.0 provides for first, second and third mandrels having diameters d, 3d and 9d respectively and the minimum diameter $D_3$ of the triple coil would be 27d.

The triple-coil of the present invention employs either or both a second or third mandrel having a diameter which is less than the diameter of the preceding coil. Accordingly in a preferred embodiment the overall diameter of the triple-coil filament is less than 27d, the theoretical limit established by previously known coiling techniques.

The minimum diameter of the triple coil as taught herein is calculated by setting the diameter of the second and third mandrels equal to the inside diameter of the preceding coils or the diameter of the mandrels. The minimum diameter of the primary mandrel $M_1$ as previously known is the wire diameter d. However the lower limit of the diameters of the second and third mandrels $M_2$ and $M_3$ is not $D_1$ and $D_2$, as previously suspected but $M_1$ whose lower limit is equal to d. Therefore, the lower limit of the outside diameter of the triple-coil filament in accordance with the present invention is equal to 15d.

It will be appreciated that the present invention provides a practical triple-coil filaments for incandescent lamps having improved design flexibility which is readily adaptable to a number of different envelope configurations. Although the lamp has been described with reference to the incandescent lamp of FIG. 1, it is readily apparent that triple-coil filament of the present invention may be used in combination with a variety of different lamp base and envelope configurations including those of miniature and sub-miniature lamps.

Although the invention has been described in its preferred form with a certain degree of particularity, it is understood that the present disclosure of the preferred embodiment is made by way of example and that modifications in the details of construction may be resorted to without departing from the true spirit and scope of this invention. It is intended that the patent shall cover, by suitable expression in the appended claims, whatever features of patentable novelty exist in the invention disclosed.

What is claimed is:

1. An incandescent lamp comprising an electrically conductive base having a hermetically sealed light-transmissive envelope attached thereto;

means for structurally and electrically mounting a filament within said envelope; and a triple-coil filament electrically connected to and supported by said means for mounting wherein at least two of the coils of the triple-coil filament have mandrel ratios less than 1.0.

2. A triple-coil filament comprising a coiled-coiled-coil of tungsten wire, said wire having a diameter d and said filament having a diameter less than 27d.

3. The triple-coil filament of claim 2 wherein the pitch ratio is 1.8 or more.

4. A triple-coil incandescent filament comprising a refractory metal wire having a diameter of 4.5 mils or less, said wire is coiled successively upon three mandrels, at least one of said mandrels having a diameter less than the diameter of the preceding coil.

5. A coiled-coil filament comprising a refractory metal wire having a diameter of 4.5 mils or less, said wire having been successively coiled upon a first and a second mandrel, said second mandrel having a diameter less than the sum of the diameter of the first mandrel diameter and twice the wire diameter.

* * * * *

Disclaimer 4,316,116.—*James A. Graves,* Highland Hts. and *Gilbert H. Reilings,* Chardon, Ohio. TRIPLE-COIL INCANDESCENT FILAMENT. Patent dated Feb. 16, 1982. Disclaimer filed May 27, 1983, by the assignee, *General Electric Co.*

Hereby enters this disclaimer to claims 1 through 5 of said patent.

[*Official Gazette July 19, 1983.*]